US010502204B2

(12) United States Patent
Rado

(10) Patent No.: US 10,502,204 B2
(45) Date of Patent: Dec. 10, 2019

(54) SYSTEM AND METHOD FOR CONTROLLING MOISTURE WITHIN AN AIR COMPRESSOR ASSEMBLY

(71) Applicant: Scott Technologies, Inc., Boca Raton, FL (US)

(72) Inventor: Gordon E. Rado, Waxhaw, NC (US)

(73) Assignee: Scott Technologies, Inc., Boca Raton, FL (US)

( * ) Notice: Subject to any disclaimer, the term of this patent is extended or adjusted under 35 U.S.C. 154(b) by 54 days.

(21) Appl. No.: 15/565,348

(22) PCT Filed: Apr. 11, 2016

(86) PCT No.: PCT/US2016/026892

§ 371 (c)(1),
(2) Date: Oct. 9, 2017

(87) PCT Pub. No.: WO2016/164880

PCT Pub. Date: Oct. 13, 2016

(65) Prior Publication Data

US 2018/0112657 A1 Apr. 26, 2018

Related U.S. Application Data

(60) Provisional application No. 62/145,748, filed on Apr. 10, 2015.

(51) Int. Cl.
*F04B 39/16* (2006.01)
*F04B 27/053* (2006.01)
(Continued)

(52) U.S. Cl.
CPC ..... *F04B 49/22* (2013.01); *F04B 25/00* (2013.01); *F04B 27/053* (2013.01); *F04B 39/06* (2013.01);
(Continued)

(58) Field of Classification Search
CPC ..... F04B 49/22; F04B 53/10; F04B 49/10; F04B 25/00; F04B 27/053; F04B 39/06;
(Continued)

(56) References Cited

U.S. PATENT DOCUMENTS 2,871,874 A * 2/1959 Coles ..... G01F 23/265 137/392
3,131,335 A * 4/1964 Berglund ..... G01F 23/241 137/392
(Continued)

FOREIGN PATENT DOCUMENTS

CN 102297115 A 12/2011
DE 2037238 U1 7/2003
(Continued)

OTHER PUBLICATIONS

International Search Report and Written Opinion dated Sep. 8, 2016 issued in corresponding PCT Application Serial No. PCT/US2016/026892, consisting of 8-pages.

*Primary Examiner* — Reinaldo Sanchez-Medina
*Assistant Examiner* — David Colon-Morales
(74) *Attorney, Agent, or Firm* — Christopher & Weisberg, P.A.

(57) ABSTRACT

An air compressor assembly for filling self-contained breathing apparatus air containers has at least one condensate separator. The condensate separator includes a liquid-retaining vessel a liquid-level sensor. A drain valve is in fluid communication with the condensate separator. The drain valve is configured to open and drain retained liquid from the liquid-retaining vessel when the liquid-level sensor detects that a level of the retained liquid reaches a drain valve activation triggering level.

16 Claims, 6 Drawing Sheets

(51) Int. Cl.

| | |
|---|---|
| ***F04B 49/10*** | (2006.01) |
| ***F04B 25/00*** | (2006.01) |
| ***F04B 49/22*** | (2006.01) |
| ***F04B 39/06*** | (2006.01) |
| ***F04B 41/02*** | (2006.01) |
| ***F04B 51/00*** | (2006.01) |
| ***F04B 53/04*** | (2006.01) |
| *F17C 5/06* | (2006.01) |

(52) U.S. Cl.
CPC ..... *F04B 39/16* (2013.01); *F04B 41/02* (2013.01); *F04B 49/10* (2013.01); *F04B 51/00* (2013.01); *F04B 53/04* (2013.01); *F17C 5/06* (2013.01); *F17C 2221/031* (2013.01); *F17C 2227/0164* (2013.01); *F17C 2270/079* (2013.01); *Y10T 137/3052* (2015.04)

(58) Field of Classification Search
CPC ..... F04B 53/08; F04B 39/16; F04B 41/02; F04B 51/00; F04B 53/04; F17C 5/06; F17C 2221/031; F17C 2227/0164; F17C 2227/079; Y10T 137/3052; F16T 1/00
See application file for complete search history.

(56) References Cited

U.S. PATENT DOCUMENTS

| | | | | | |
|---|---|---|---|---|---|
| 3,547,145 | A * | 12/1970 | Holzer | D06F 39/087 | 137/392 |
| 4,336,821 | A * | 6/1982 | Frantz | B61C 17/02 | 137/187 |
| 4,974,626 | A * | 12/1990 | Koch | F16T 1/00 | 137/187 |
| 5,337,779 | A * | 8/1994 | Fukuhara | F16T 1/00 | 137/187 |
| 5,513,678 | A * | 5/1996 | Schultz | F17C 5/06 | 141/198 |
| 6,196,253 | B1 * | 3/2001 | Love | F16K 13/10 | 137/187 |
| 6,203,285 | B1 * | 3/2001 | Wagner | F04B 25/00 | 417/243 |
| 6,276,894 | B1 * | 8/2001 | Koch | F16T 1/00 | 137/187 |
| 6,279,593 | B1 * | 8/2001 | Sheppard | F16T 1/00 | 137/1 |
| 6,588,443 | B2 * | 7/2003 | Schlensker | F16T 1/00 | 137/178 |
| 7,204,249 | B1 | 4/2007 | Richey, II et al. | | |
| 7,415,995 | B2 * | 8/2008 | Plummer | F17C 6/00 | 141/192 |
| 7,823,609 | B2 * | 11/2010 | Wonders | F17C 5/06 | 141/18 |
| 8,075,668 | B2 * | 12/2011 | Delmotte | F04B 25/00 | 417/228 |
| 8,961,147 | B2 * | 2/2015 | Van Campfort | F16T 1/00 | 417/243 |
| 9,222,477 | B2 * | 12/2015 | Durham | F04D 15/0088 | |
| 9,243,753 | B2 * | 1/2016 | Wonders | F17C 5/06 | |
| 9,303,817 | B2 * | 4/2016 | Feltgen | F04B 39/16 | |
| 9,310,024 | B2 * | 4/2016 | Plummer | F17C 13/003 | |
| 9,377,129 | B2 * | 6/2016 | Schlensker | F16T 1/14 | |
| 9,494,280 | B2 * | 11/2016 | Schlensker | F16T 1/00 | |
| 9,500,102 | B2 * | 11/2016 | Lee | F16T 1/383 | |
| 9,765,932 | B2 * | 9/2017 | Rado | F17C 5/06 | |
| 9,927,066 | B1 * | 3/2018 | Wonders | F17C 5/002 | |
| 9,933,115 | B2 * | 4/2018 | Rado | F17C 5/06 | |
| 10,042,371 | B2 * | 8/2018 | Borkowski | G05D 9/12 | |
| 2002/0157705 | A1 | 10/2002 | Schlensker et al. | | |
| 2007/0264135 | A1 * | 11/2007 | Hartl | F04B 39/06 | 417/243 |
| 2014/0150891 | A1 | 6/2014 | Schlensker | | |
| 2015/0267835 | A1 * | 9/2015 | Jones | F16K 37/005 | 251/129.03 |
| 2018/0112657 | A1 * | 4/2018 | Rado | F04B 39/16 | |

FOREIGN PATENT DOCUMENTS

| | | | |
|---|---|---|---|
| DE | 20307238 | U1 * | 8/2003 |
| WO | 2013/066331 | A2 | 5/2013 |

* cited by examiner

SYSTEM AND METHOD FOR CONTROLLING MOISTURE WITHIN AN AIR COMPRESSOR ASSEMBLY

CROSS-REFERENCE TO RELATED APPLICATION

This Application is a submission under 35 U.S.C. § 371 for U.S. National Stage Patent Application of International Application No. PCT/IB2016/026892, filed Apr. 11, 2016 entitled "SYSTEM AND METHOD FOR CONTROLLING MOISTURE WITHIN AN AIR COMPRESSOR ASSEMBLY" which claims priority to U.S. Provisional Application No. 62/145,748 filed Apr. 10, 2015, entitled "SYSTEM AND METHOD FOR CONTROLLING MOISTURE WITHIN AN AIR COMPRESSOR ASSEMBLY" the entireties of both of which are incorporated herein by reference.

FIELD

Embodiments of the present disclosure generally relate to systems and methods for controlling moisture, such as caused by condensation, within an air compressor assembly.

BACKGROUND

Pressurized fluid compressor elements are used in various settings. For example, a self-contained breathing apparatus (SCBA) typically includes an air compressor element that is used to provide safe, clean air to an individual for breathing. An SCBA is configured to be worn by individuals, such as rescue workers, firefighters, and others, to provide breathable air in a hazardous or otherwise unsafe atmosphere. When configured for use underwater, an SCBA is typically referred to as a self-contained underwater breathing apparatus (SCUBA).

SCBAs and various other fluid compressor elements may be charged or filled through the use of an air compressor. The process of compressing air to a suitable pressure that may recharge an SCBA compressor element is generally performed in four or five stages. An intercooler may be disposed between each stage. The intercooler is used to remove heat generated through the compression process.

A condensate separator is used to remove water drawn into the compressor, such as caused by humidity in the air. After a predetermined period of operation, the accumulated water is expelled from the system. For example, a drain or dump valve plumbed to each of the separators opens an exit path to the atmosphere that allows the air pressure in each separator to expel the water. In known air compressor assemblies, the drain valve is pilot operated by a solenoid valve that uses low pressure air from the compressor second stage to open the passage. Typically, the drain valve is either activated via a manual signal at the discretion of an operator, or through a timer. In each case, a prediction is made as to how often to open each drain valve. If the drain valves are operated too often, compressed air energy is needlessly wasted. Conversely, if the drain valves are not activated enough, the compressor may be damaged, such as through retained water leaking onto or into internal components.

In general, the amount of condensate water is influenced by the local air humidity during compressor operation so that a compressor used in Florida, for example, accumulates condensate quicker than one operated in Nevada. Therefore, relying on a timer to activate the drain valves may not be sufficient in high humidity environments, and inefficient in low humidity environments.

SUMMARY

An embodiment an air compressor assembly for filling self-contained breathing apparatus air containers includes at least one condensate separator. The at least one condensate separator includes a liquid-retaining vessel a liquid-level sensor. At least one drain valve in fluid communication with the at least one condensate separator is included, the at least one drain valve being configured to open and drain retained liquid from the liquid-retaining vessel when the liquid-level sensor detects that a level of the retained liquid retained within the liquid-retaining vessel reaches a drain valve activation triggering level.

In another aspect of this embodiment, the liquid-level sensor is a continuity sensor, and the liquid-level sensor is one of an optical sensor and an acoustic sensor.

In another aspect of this embodiment, the air compressor assembly is a multi-stage breathing air compressor configured to fill self-contained breathing apparatus breathing air containers.

In another aspect of this embodiment, the drain valve includes a solenoid, the solenoid being activated when the liquid-level sensor detects that the level of the retained liquid retained within the liquid-retaining vessel reaches the drain valve activation triggering level.

In another aspect of this embodiment, the at least one condensate separator includes a plurality of condensate separators in fluid communication with the at least one drain valve, and wherein each one of the plurality of condensate separators has a corresponding liquid-level sensor.

In another aspect of this embodiment, the at least one drain valve is configured to simultaneously drain retained liquid within the plurality of condensate separators when any one of the liquid-level sensors within a corresponding condensate separator detects that the level of retained liquid retained within the corresponding liquid-retaining vessel reaches the drain valve activation triggering level.

In another aspect of this embodiment, the air compressor includes at least a first stage and a second stage of air compression, and wherein one of the plurality of condensate separators is fluidly disposed between the first stage and the second stage, and wherein the at least one drain valve is configured to drain liquid within the plurality of condensate separators when liquid-level sensor within the condensate separator between the first stage and the second stage detects that the level of retained liquid retained within its liquid-retaining vessel reaches the drain valve activation triggering level.

In another aspect of this embodiment, the at least one drain valve is configured to drain the liquid-retaining vessel for a predetermined amount of time.

In another embodiment, the air compressor assembly is a multi-stage air compressor including a first stage compressor and a second stage compressor. A first condensate separator is included and disposed between and in fluid communication with the first stage compressor and the second stage compressor. The first condensate separator includes a first liquid-retaining vessel and a first liquid-level sensor. A controller in communication with the first liquid-level sensor is included. A drain valve in fluid communication with the first condensate separator is included, the controller being configured to send a drain valve activation signal to the drain valve, the drain valve activation signal being configured to open the drain valve and drain retained liquid from the liquid-retaining vessel when the first liquid-level sensor detects that a level of the retained liquid retained within the first liquid-retaining vessel reaches a drain valve activation triggering level.

In another aspect of this embodiment, the multi-stage air compressor includes a second liquid-level sensor, the second liquid-level sensor being positioned to detect a lower level of liquid in the first retaining vessel than the first liquid-level sensor, and wherein the controller is further configured to close the drain valve when the second liquid-level sensor detects that the level of the retained liquid retained within the first liquid-retaining vessel reaches a drain valve termination triggering level.

In another aspect of this embodiment, the liquid-level sensor is a continuity sensor, and the liquid-level sensor is one of an optical sensor and an acoustic sensor.

In another aspect of this embodiment, the multi-stage air compressor includes a third stage compressor and a second condensate separate disposed between and in fluid communication with the second stage compressor and the third stage compressor, the second condensate separator including a second liquid-retaining vessel.

In another aspect of this embodiment, the second liquid-retaining vessel is in fluid communication with the drain valve, and wherein when the drain valve activation signal causes the drain valve to open when the level of the retained liquid retained within the first liquid-retaining vessel reaches the drain valve activation triggering level, liquid within the second-liquid retaining vessel is drained.

In another aspect of this embodiment, the multi-stage air compressor includes a reservoir in fluid communication with the drain valve, the reservoir configured to retain water drained from the first liquid-retaining vessel.

In another aspect of this embodiment, the drain valve is configured to drain the first liquid-retaining vessel for a predetermined amount of time.

In another embodiment, the air compressor assembly is a multi-stage air compressor including a first stage compressor, a second stage compressor, and a third stage compressor. A first condensate separator is included and disposed between and in fluid communication with the first stage compressor and the second stage compressor. The first condensate separator includes a first liquid-retaining vessel and a first high level liquid-level sensor and a first low level liquid-level sensor disposed within the first liquid-retaining vessel. A second condensate separator is included and disposed between and in fluid communication with the second stage compressor and the third stage compressor. The second condensate separator includes a second liquid-retaining vessel and a second high level liquid-level sensor and a second low level liquid-level sensor disposed within the first liquid-retaining vessel. A solenoid drain valve is in fluid communication with the first condensate separator and the second condensate separator. A controller in communication with the first high level liquid-level sensor, the first low level liquid-level, the second high level liquid-level sensor, and the second low level liquid-level is included. The control is configured to send a drain valve activation signal to the drain valve, the drain drive activation signal being configured to open the drain valve to drain the liquid retained within the first liquid-retaining vessel and the second liquid-retaining vessel when at least one of the first high level liquid-level sensor and the second high level liquid-level sensor detects that a level of the retained liquid retained within at least one of the first liquid-retaining vessel and the second-liquid retaining vessel reaches a drain valve activation triggering level. The controller is further configured to send a drain valve termination signal to the drain valve, the drain drive termination signal being configured to close the drain valve when at least one of the low level liquid-level sensor and the second low level liquid level sensor detects that a level of the retained liquid retained within at least one of the first liquid-retaining vessel and the second-liquid retaining vessel reaches a drain valve termination triggering level.

DETAILED DESCRIPTION

The foregoing summary, as well as the following detailed description of certain embodiments will be better understood when read in conjunction with the appended drawings. As used herein, an element or step recited in the singular and proceeded with the word "a" or "an" should be understood as not excluding plural of the elements or steps, unless such exclusion is explicitly stated. Further, references to "one embodiment" are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

Embodiments of the present disclosure provide a system and method of directly monitoring a liquid (condensate) level in separators of an air compressor assembly so that the drain (dump) valves are opened when liquid reaches a predetermined level. As such, the drain valves are opened automatically based on the liquid level within the separators reaching a drain valve activation triggering level. There is no guess work in this arrangement as the system automatically adjusts to the local and day-to-day environment. The air compressor assembly may include a continuity detector that changes state when an electrode tip is covered by water. Such a device may be installed at an appropriate distance from the bottom of one or more of the condensate separators, where it will sense water and trigger the drain valve. Embodiments of the present disclosure are configured for use with a fully automatic SCBA filling system because they operate without an individual ever being required to have any training or knowledge.

Figure 1:
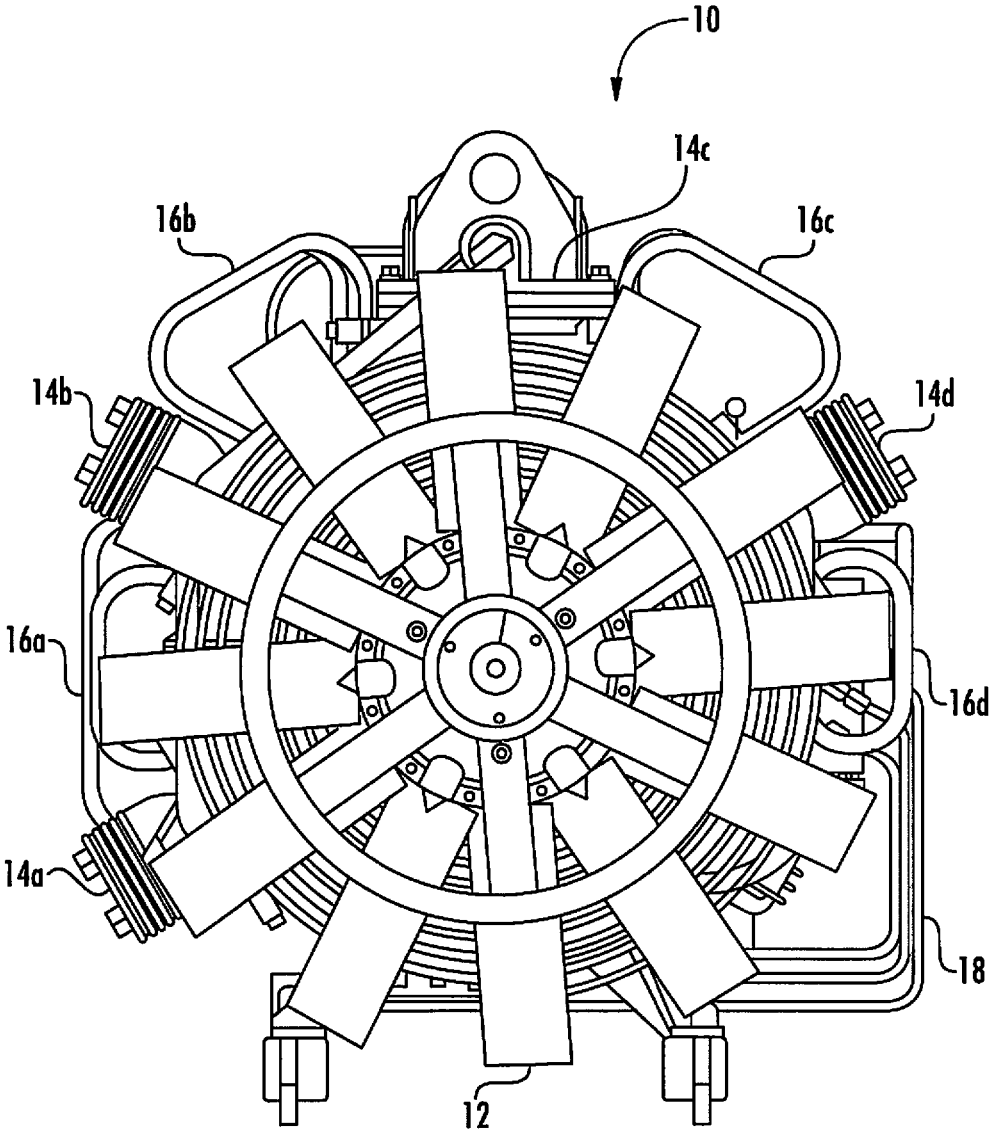
FIG. 1 illustrates a front view of an air compressor assembly, according to an embodiment of the present disclosure.
Figure 2:
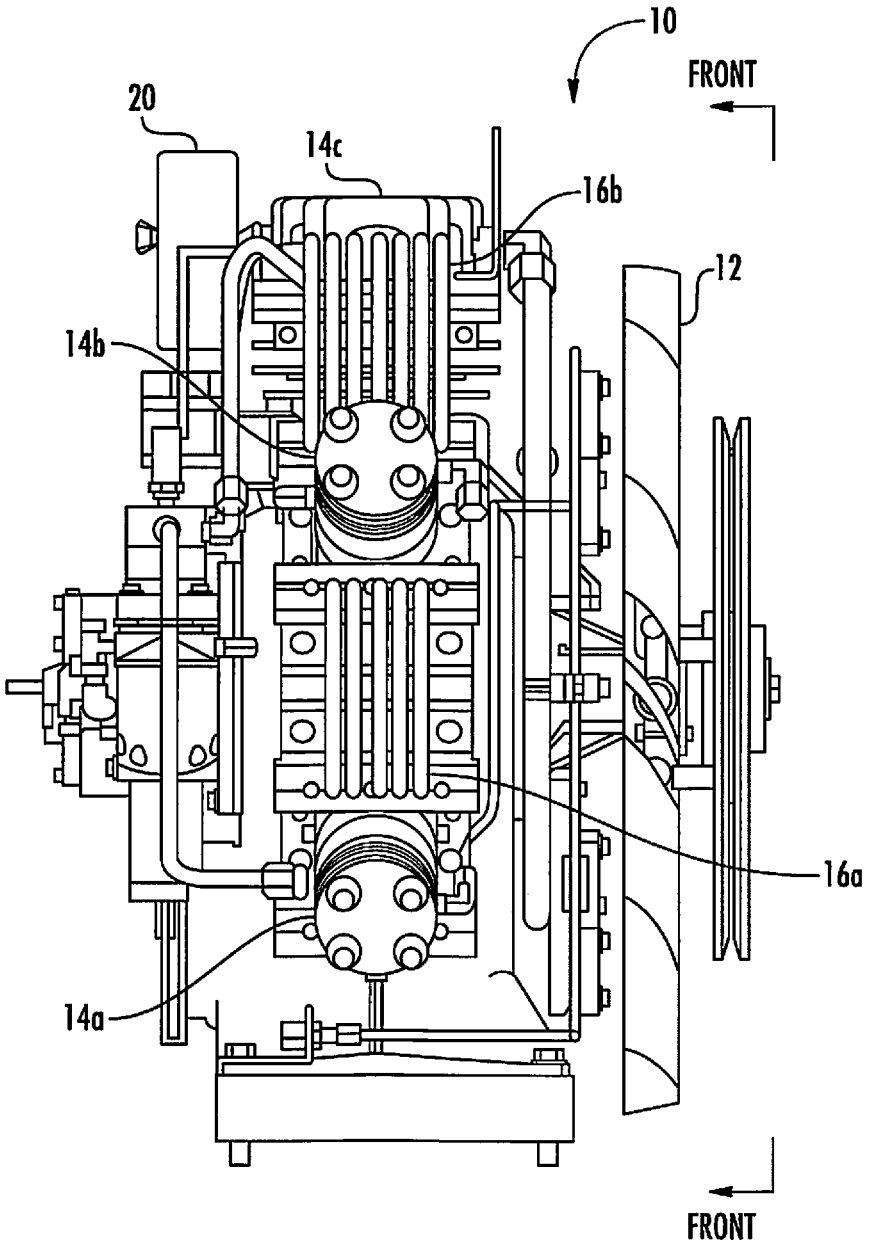
FIG. 2 illustrates a side view of the air compressor assembly shown in FIG. 1.

Now referring to the drawings in which like reference designators refer to like elements, there is shown in FIGS. 1-2 an exemplary air compressor assembly constructed in according to an embodiment of the present disclosure and designated generally as "10." The air compressor assembly 10 may be a multi-stage stage breathing air compressor that includes, among other components, a cooling fan 12, compressor elements 14*a-d* (collectively, compressor elements 14), intercoolers 16*a-d* (collectively, intercoolers 16), and condensate drain lines 18. In one configuration, five stages of compression are contemplated, and in other configurations fewer stages are contemplated. A "stage of compression," as used herein, refers to the number of times air is compressed sequentially within one of the compressor elements 14, for example, by cylinder that includes a piston and a rod, which is referred to as a stage compressor. The first stage compressor thus includes a first compressor element 14*a,* e.g., cylinder, and during operation, air is drawn into the first stage compressor element 14*a* through an air intake filter 20 (FIG. 3), where it is compressed and then passed through the first stage intercooler 16*a* before being passed into the second stage compressor element 14*b* for further compression. The second stage compressor includes compressor element 14*b,* in which the air is further compressed and then passed through a second intercooler 16*b*. The same process used for the second stage of compression and repeated for the remaining stages of compression.

Figure 3:
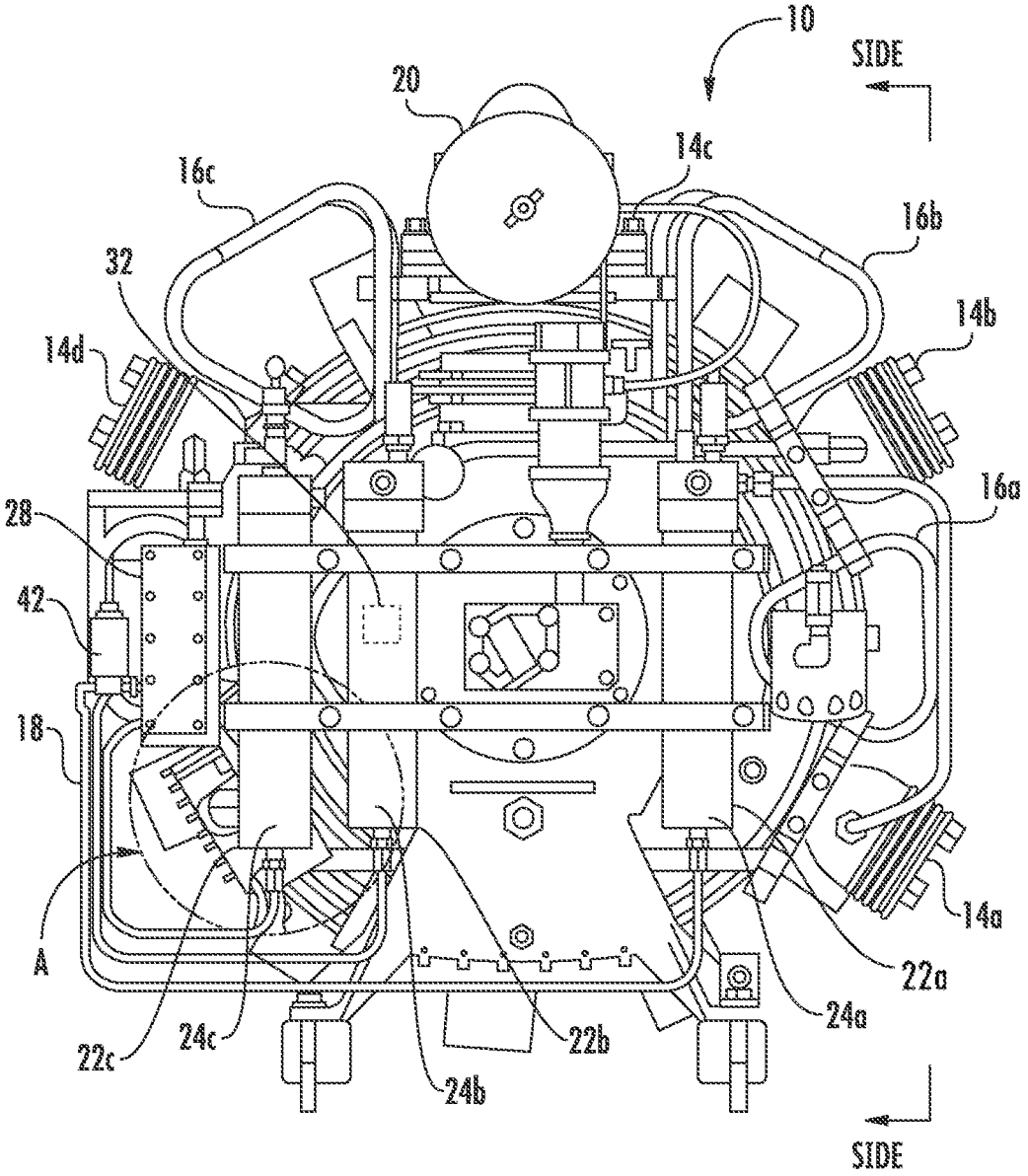
FIG. 3 illustrates a rear view of the air compressor assembly shown in FIG. 1.

Referring now to FIG. 3, disposed between and in fluid communication with the first stage compressor, i.e., compressor element 14*a,* and the second stage compressor, i.e. compressor element 14*b* is a first condensate separator 22*a* configured to separate liquid, for example, water, from the air being compressed. As the compressed air is moved between the first stage compressor and the second stage compressor, intercooler 16*a* exchanges heat with the ambient air which is blown across the intercooler 16*a* with the cooling fan 12, which creates condensation. The first condensate separator 22*a* includes a liquid-retaining vessel 24*a* configured to retain the condensation separated from the air flow, and a high level liquid level sensor 26*a*. In an exemplary configuration, the high level liquid-level sensor 26*a* is disposed within or on the interior of the liquid-retaining vessel 24*a*. The high level liquid-level sensor 26*a* is configured to detect attainment of a predetermined level of liquid within the liquid-retaining vessel 24*a*. In one configuration, the high level liquid-level sensor 26*a* is a continuity sensor including a probe that changes state when the probe is covered by a liquid such as water. In one embodiment, the high level liquid-level sensor 26*a* may be an optical, acoustic, or other such sensor. For example, the high level liquid-level sensor 26*a* may emit an acoustic signal that reflects off the upper surface of the water. As another example, the high level liquid-level sensor 26*a* may emit an optical signal, such as a beam of light, which is broken by the water as it reaches the level of the high level liquid-level sensor 26*a*. Various other types of sensors may be used. Moreover, the height of the high level liquid-level sensor 26*a* within the liquid-retaining vessel 24*a* may be adjusted depending on the particular environment. For example, in drier environments the high level liquid-level sensor 26*a* may be positioned at a higher level within the liquid-retaining vessel 24*a* and at a lower level in more humid environments.

As shown in FIG. 3, in fluid communication the first condensate separator 22*a* via at one of the drain lines 18 coupled to the liquid-retaining vessel 24*a* is at least one drain valve 28. In particular, the drain lines 18 may extend and direct liquid away from liquid-retaining vessel 24*a* toward the at least one drain valve 28. The at least one drain valve 28 may include a solenoid or other electrically operated component that opens and closes the drain valve 28 in response to an instruction/signal from the processor 38 (shown in FIGS. 6 and 7). In embodiment, the processor 38 signals the valve drive 41 (shown in FIGS. 6 and 7) in which the valve drive 41 is configured to generate an electric signal sufficient to opens the drain valve 28. In one embodiment, the valve drive 41 can be an electrical circuit that includes a power transistor that can generate sufficient current to activate the drain valve 28. When the high level liquid-level sensor 26*a* detects that the level of water is at a predetermined drain valve activation triggering level 30, the high level liquid-level sensor 26*a* sends one or more signals to a controller 32, which sends a drain valve activation signal to open the at least one drain valve 28. In an exemplary configuration, in response to the drain valve activation signal, which may be an energizing signal from the controller 32, the at least one drain valve 28 opens and air from the second stage of compression opens the liquid-retaining vessel 24 a to atmospheric pressure, which pushed liquid out from the first stage of compression. In other configurations, the opening of the at least one drain valve 18 automatically releases the pressure within compressor element 14*a* which causes the ejection of the liquid from the compressor element 14*a*.

Figure 5:
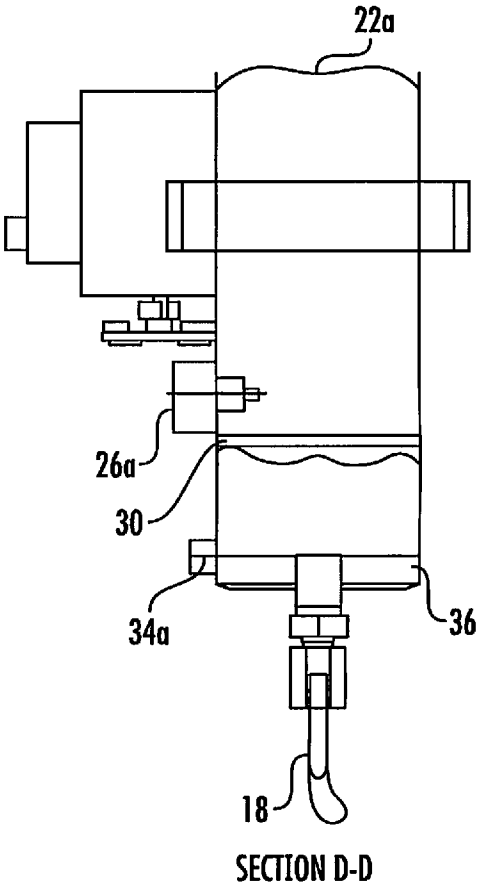
FIG. 5 illustrates a cross-sectional view of the condensate separator shown in FIG. 4 through line D-D of FIG. 4.
Figure 4:
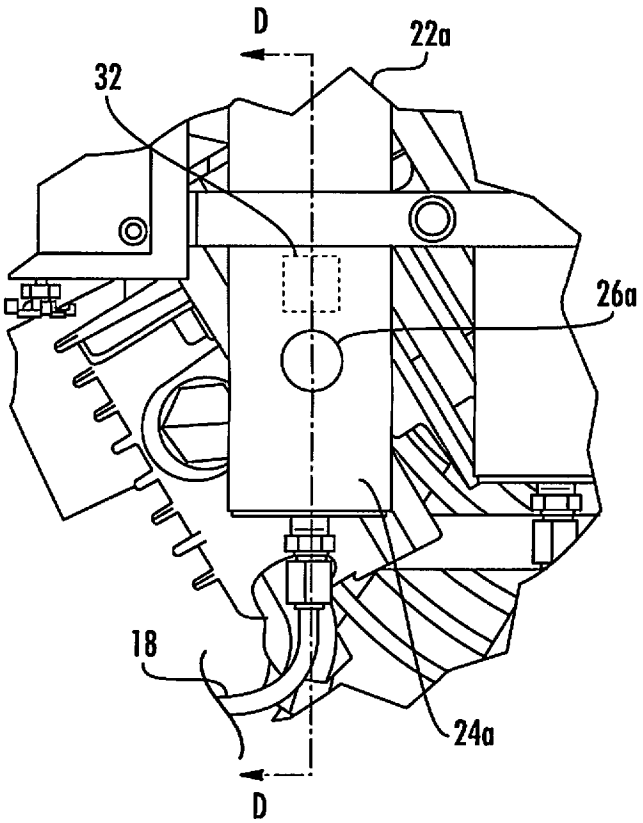
FIG. 4 illustrates a zoomed in view of section "A" of the condensate separator of the air compressor assembly shown in FIG. 1.

Referring now to FIGS. 3-5, condensate separators 22*a-c* (collectively, condensate separators 22), and their corresponding liquid-retaining vessels 24*b* and 24*c* may also include corresponding high level liquid-level sensors 26*b* and 26*c,* each in communication with the controller 32. Condensate separator 22*b* and intercooler 16*b* may be disposed between and in fluid communication with the second stage compressor and the third stage compressor and condensate separator 22*c* and intercooler 16*c* may be disposed between and in fluid communication with the third stage compressor and the fourth stage compressor. Similar to liquid-retaining vessel 24*a,* liquid-retaining vessel 24*b* and 24*c* may each include high level liquid-level sensor 26*b* and high level liquid-level sensor 26*c* respectively (collectively, high level liquid-level sensor 26*a,* 26*b,* and 26*c* are referred to as high level liquid-level sensor 26). Each of the liquid-retaining vessels 24*a,* 24*b,* and 24*c* (collectively, liquid-retaining vessels 24) may be in fluid communication with the at least one drain valve 28 and corresponding drain lines 18. In some embodiments, one or more of the liquid-retaining vessels 24*a,* 24*b,* and 24*c* may include a low level liquid-level sensors 34*a,* 34*b,* and 34*c* (collectively, low level liquid-level sensors 34) disposed within its interior. The low level liquid-level sensors 34 are similar configured to the high level liquid-level sensors 26 in that they are configured to sense a level of liquid within the corresponding liquid-retaining vessel 24. The low level liquid-level sensors 34 may be adjustable in height within their corresponding liquid-retaining vessels 24 and may be used to determine when the liquid retained within the corresponding liquid-retaining vessels 24 is entirely or substantially entirely drained. In particular, when the liquid within the liquid-retaining vessels drains as a function of the high level liquid-level sensors 26 triggering the draining of the liquid within, the low level liquid-level sensors 34 are configured to trigger a predetermined drain valve termination triggering level 36 from the controller 32, which close the drain valve 28.

Figure 6:
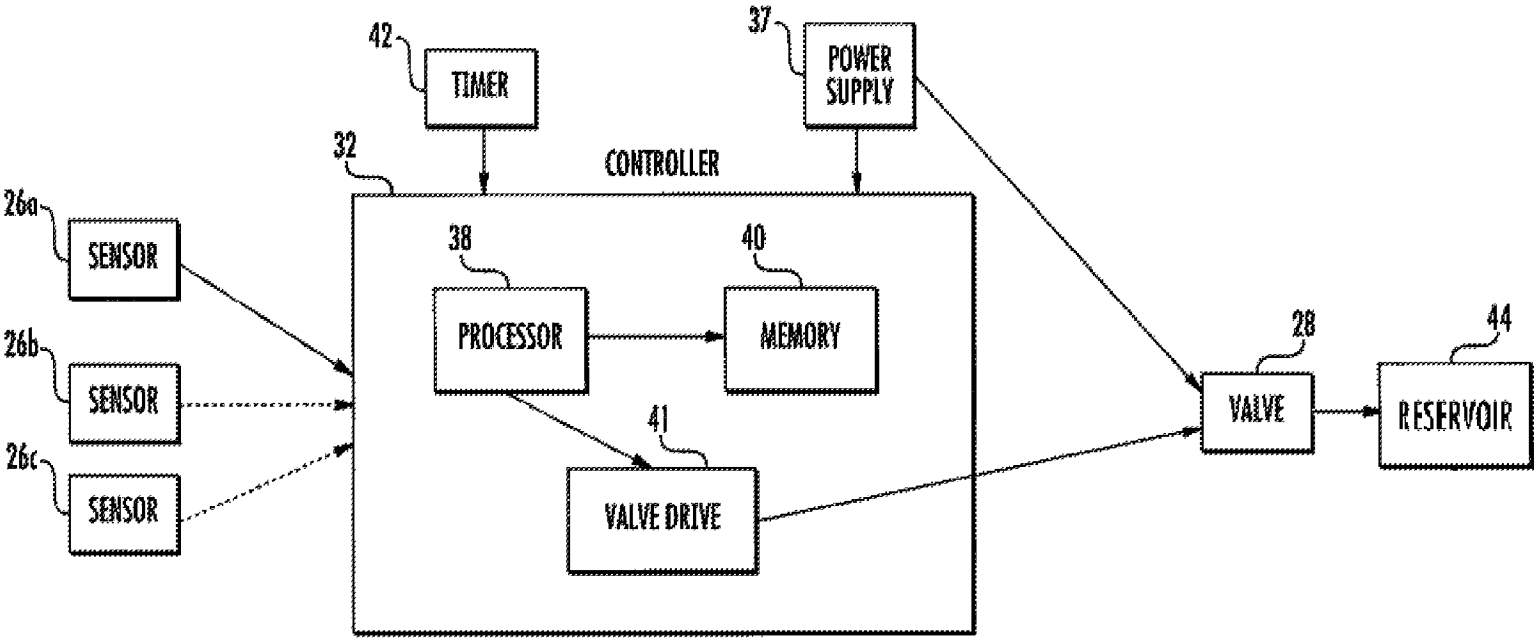
FIG. 6 is a block diagram of a controller for an embodiment of the air compressor assembly with a single liquid-level sensor per liquid-retaining vessel.
Figure 7:
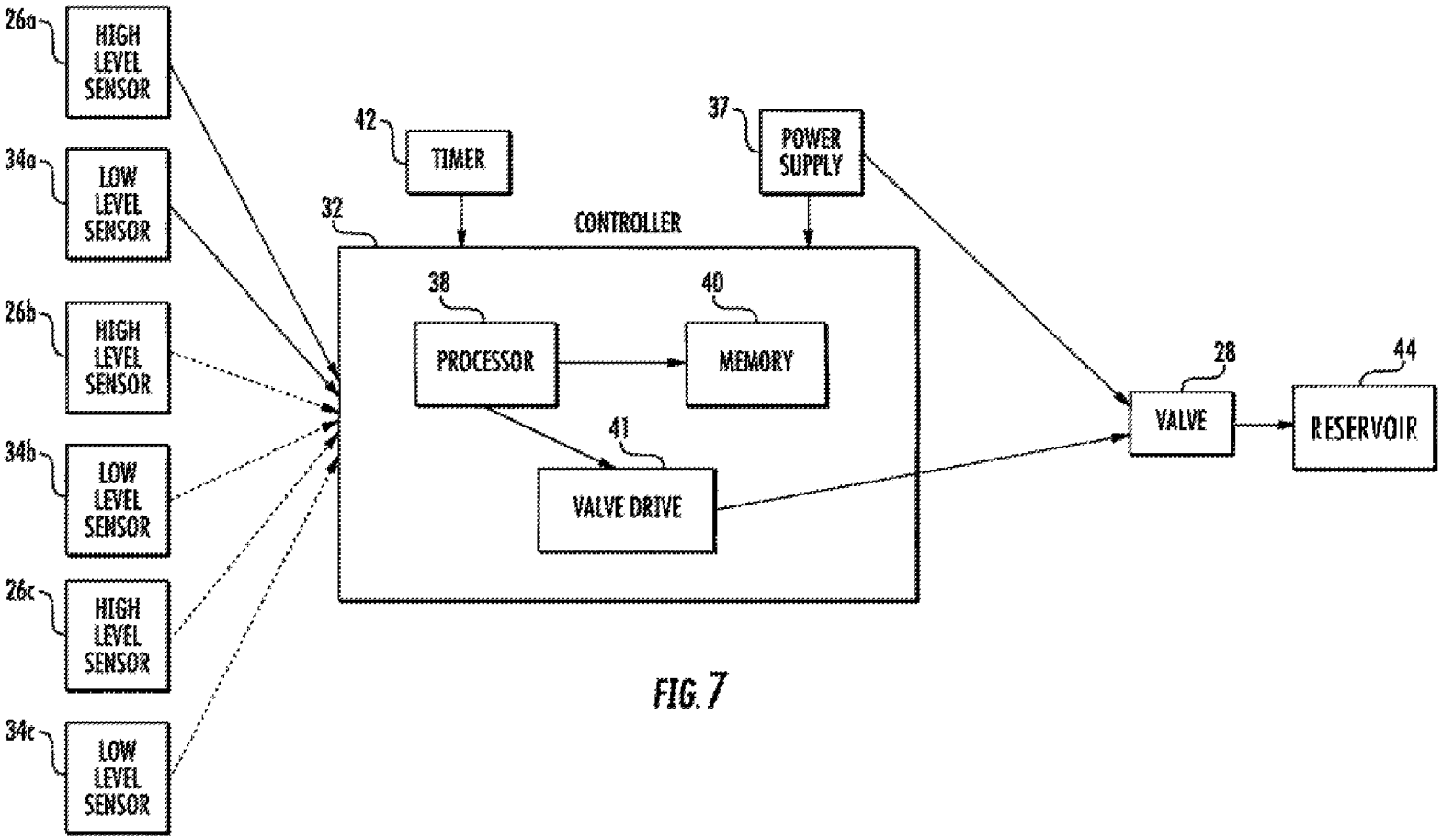
FIG. 7 is a block diagram of a controller for another embodiment of the air compressor assembly.

Referring now to FIGS. 6 and 7, in an exemplary configuration and method of use, the controller 32 may be in communication with a power source 37 and include a processor 38 having processing circuity in communication with a memory 40. During operation of the air compressor assembly 10, intake air is passed through air intake filter 20 and compressed in the first stage of compression including compressor element 14*a* and then circulated through intercooler 16*a* to cool the compressed air. The cooling of the compressed air creates condensation which is separated between the first stage of compression and the second stage of compression by the condensate separator 22*a* and stored in liquid-retaining vessel 24*a*. The compressed air is then moved through additional stages of compression, depending on the particular air compressor assembly. For example, the compressed air from the first stage of compression may be circulated to the second stage of compression including second compressor element 14*b*, and then to the third stage of compression including compressor element 14*c*. Liquid from each stage of compression may be separated and retained within a corresponding liquid-retaining vessel 24.

In one configuration, only liquid-retaining vessel 24*a* includes the high level liquid-level sensors 26 and the remaining liquid-retaining vessels 24*b* and 24*c* do not include any high level liquid-level sensors 26. When the retained liquid within liquid-retaining vessel 24*a* reaches the drain valve activation triggering level 30, the high-level liquid-level sensor 26*a* is triggered and a drain valve activation signal is received by the controller 32, which sends a drain valve drive signal that drives the at least one drain valve 28 including a solenoid to open the at least one drain valve 28 to atmosphere. The air pressure in condensate separators 22 causes evacuation of the liquid when the at least one valve is open, which simultaneously drains the liquid from liquid-retaining vessels 24*b* and 24*c*. In one configuration, the assembly includes a system control timer 42 which may be set to allow enough valve open time for complete condensate expulsion, after which the solenoid is automatically de-energized and the at least one drain valve 28 is closed. The control timer 42 may be set to causes generation of the drain valve drive signal for a predetermined period of time, for example, 15 seconds, which may depend on the ambient environment. For example, the timer 42 may be set for longer periods of time in humid environments and shorter periods of time in drier environments. In other configurations, liquid-retaining vessel 24*a* may include low level liquid-level sensor 34*a*. When the liquid is expelled from the liquid-retaining vessel 24*a*, the at least one drain valve 28 may remain open until the low level liquid-level sensor 34*a* detects that a level of liquid has reached the drain valve termination triggering level 36, at which point the controller 32 causes the at least one drain valve 28 to close. The liquid expelled from the liquid-retaining vessels 24 may be stored in a reservoir 44.

In another configuration, the liquid-retaining vessels 24*b* and 24*c* may each include the high level liquid-level sensor 26 and low level liquid-level sensor 34. Alternatively, liquid-retaining vessels 24 can include both, one, or neither of high level liquid-level sensor 26 and low level liquid-level sensor 34. In the configuration in which in which each liquid-retaining vessels 24 includes both the high level liquid-level sensor 26 and low level liquid-level sensor 34, the controller 22 may be configured to send the valve activation signal to open the at least one drain valve 28 when the liquid level for drain valve activation is reached in any one of the condensate separators 22 and their corresponding liquid-retaining vessels 24. Moreover, the at least one drain valve 28 may remain open until the last of the low level liquid-level sensor 34 reaches the liquid level for drain valve termination, at which time the controller 22 may cause the at least one drain valve 28 to close. The benefits of the air compressor assembly 10 includes minimizing the waste of compressed air to remove liquid from the air flow by controlling the open/closing function of the at least one drain valve 28 based on the presence of the liquid. Such a benefit allows the air compressor assembly 10 to run longer in dry environments and conserves energy.

Accordingly, embodiments of the present disclosure provide a system and method of efficiently operating an air compressor assembly. Embodiments of the present disclosure provide a system and method of automatically activating drain valves of an air compressor based on a detected level of retained water within one or more condensate separators.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope of the invention, which is limited only by the following claims.

What is claimed is:

1. An air compressor assembly for filling self-contained breathing apparatus air containers, the air compressor assembly comprising:

a plurality of condensate separators, each of the plurality of condensate separators including:

a liquid-retaining vessel; and a liquid-level sensor; and at least one drain valve in fluid communication with the plurality of condensate separators, the at least one drain valve being configured to open and simultaneously drain retained liquid from the liquid-retaining vessel of each of the plurality of condensate separators when the liquid-level sensor of any one of the plurality of condensate separators detects that a level of the retained liquid retained within the liquid-retaining vessel reaches a drain valve activation triggering level.

2. The air compressor assembly of claim 1, wherein the liquid-level sensor is a continuity sensor.

3. The air compressor assembly of claim 1, wherein the liquid-level sensor is an optical sensor.

4. The air compressor assembly of claim 1, wherein the liquid-level sensor is an acoustic sensor.

5. The air compressor assembly of claim 1, wherein the air compressor assembly is a multi-stage breathing air compressor configured to fill self-contained breathing apparatus breathing air containers.

6. The air compressor assembly of claim 1, wherein the at least one drain valve includes a solenoid, the solenoid being activated when the liquid-level sensor of any one of the plurality of condensate separators detects that the level of the retained liquid retained within the liquid-retaining vessel reaches the drain valve activation triggering level.

7. The air compressor assembly of claim 1, wherein the air compressor includes at least a first stage and a second stage of air compression, and wherein one of the plurality of condensate separators is fluidly disposed between the first stage and the second stage, and wherein the at least one drain valve is configured to drain liquid within the plurality of condensate separators when liquid-level sensor within the condensate separator between the first stage and the second stage detects that the level of retained liquid retained within its liquid-retaining vessel reaches the drain valve activation triggering level.

8. The air compressor assembly of claim 1, wherein the at least one drain valve is configured to drain the liquid-retaining vessel for a predetermined amount of time.

9. A multi-stage air compressor assembly for filling self-contained breathing apparatus air containers, the air compressor assembly comprising:

a first stage compressor;

a second stage compressor;

a third stage compressor;

a first condensate separator disposed between and in fluid communication with the first stage compressor and the second stage compressor, the first condensate separator including:

a first liquid-retaining vessel; and a first liquid-level sensor of the first condensate separator;

a second condensate separator disposed between and in fluid communication with the second stage compressor and the third stage compressor, the second condensate separator including:

a second liquid-retaining vessel; and a first liquid-level sensor of the second condensate separator;

a controller in communication with the first liquid-level sensor; and a drain valve in fluid communication with the first liquid-retaining vessel and the second liquid-retaining vessel, the controller being configured to send a drain valve activation signal to the drain valve, the drain valve activation signal being configured to open the drain valve and simultaneously drain retained liquid from the first liquid-retaining vessel and the second liquid-retaining vessel when the first liquid-level sensor of the first condensate separator detects that a level of the retained liquid retained within the first liquid-retaining vessel reaches a drain valve activation triggering level.

10. The multi-stage air compressor assembly of claim 9, wherein the first condensate separator further a second liquid-level sensor of the first condensate separator, the second liquid-level sensor of the first condensate separator being positioned to detect a lower level of liquid in the first retaining vessel than the first liquid-level sensor of the first condensate separator, and wherein the controller is further configured to close the drain valve when the second liquid-level sensor of the first condensate separator detects that the level of the retained liquid retained within the first liquid-retaining vessel reaches a drain valve termination triggering level.

11. The multi-stage air compressor assembly of claim 9, wherein the first liquid-level sensor of the first condensate separator is a continuity sensor.

12. The multi-stage air compressor assembly of claim 9, wherein the first liquid-level sensor of the first condensate separator is an optical sensor.

13. The multi-stage air compressor assembly of claim 9, wherein the first liquid-level sensor of the first condensate separator is an acoustic sensor.

14. The multi-stage air compressor assembly of claim 9, further comprising a reservoir in fluid communication with the drain valve, the reservoir configured to retain water drained from the first liquid-retaining vessel and the second liquid-retaining vessel.

15. The multi-stage air compressor assembly of claim 9, wherein the drain valve is configured to simultaneously drain the first liquid-retaining vessel and the second liquid-retaining vessel for a predetermined amount of time.

16. A multi-stage air compressor assembly for filling self-contained breathing apparatus air containers, the air compressor assembly comprising:

a first stage compressor;

a second stage compressor;

a third stage compressor;

a first condensate separator disposed between and in fluid communication with the first stage compressor and the second stage compressor, the first condensate separator including:

a first liquid-retaining vessel; and a first high level liquid-level sensor and a first low level liquid-level sensor disposed within the first liquid-retaining vessel;

a second condensate separator disposed between and in fluid communication with the second stage of compression and the third stage of compression, the second condensate separator including:

a second liquid-retaining vessel; and a second high level liquid-level sensor and a second low level liquid-level sensor disposed within the second liquid-retaining vessel;

a solenoid drain valve in fluid communication with the first condensate separator and the second condensate separator; and a controller in communication with the first high level liquid-level sensor, the first low level liquid-level, the second high level liquid-level sensor, and the second low level liquid-level, the controller being configured to:

send a drain valve activation signal to the drain valve, the drain drive activation signal being configured to open the drain valve to simultaneously drain the liquid retained within the first liquid-retaining vessel and the second liquid-retaining vessel when at least one of the first high level liquid-level sensor and the second high level liquid-level sensor detects that a level of the retained liquid retained within at least one of the first liquid-retaining vessel and the second-liquid retaining vessel reaches a drain valve activation triggering level; and send a drain valve termination signal to the drain valve, the drain drive termination signal being configured to close the drain valve when at least one of the low level liquid-level sensor and the second low level liquid level sensor detects that a level of the retained liquid retained within at least one of the first liquid-retaining vessel and the second-liquid retaining vessel reaches a drain valve termination triggering level.

* * * * *